US008295717B2

(12) United States Patent
Miyazaki et al.

(10) Patent No.: US 8,295,717 B2
(45) Date of Patent: Oct. 23, 2012

(54) IMAGE FORMING APPARATUS

(75) Inventors: Rumi Miyazaki, Osaka (JP); Atsushi Takehara, Kyoto (JP); Keiji Kunimi, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 260 days.

(21) Appl. No.: 12/582,474

(22) Filed: Oct. 20, 2009

(65) Prior Publication Data

US 2010/0098441 A1 Apr. 22, 2010

(30) Foreign Application Priority Data

Oct. 21, 2008 (JP) ..... 2008-270760

(51) Int. Cl.
*G03G 15/08* (2006.01)
*G03G 15/00* (2006.01)

(52) U.S. Cl. ..... 399/27; 399/29; 399/49

(58) Field of Classification Search ..... 399/27, 399/29, 49
See application file for complete search history.

(56) References Cited

U.S. PATENT DOCUMENTS

| | | | |
|---|---|---|---|
| 6,292,206 | B1 | 9/2001 | Takehara et al. |
| 6,295,438 | B1 | 9/2001 | Fujishiro et al. |
| 6,334,039 | B1 | 12/2001 | Yoshinaga et al. |
| 6,366,754 | B1 | 4/2002 | Sato et al. |
| 6,782,227 | B2 | 8/2004 | Ishibashi et al. |
| 7,003,238 | B2 | 2/2006 | Yoshida et al. |
| 7,139,497 | B2 | 11/2006 | Takehara |
| 7,174,124 | B2 | 2/2007 | Ishibashi et al. |
| 7,203,433 | B2 | 4/2007 | Kato et al. |
| 7,280,792 | B2 | 10/2007 | Sawai et al. |
| 7,428,400 | B2 | 9/2008 | Iwakura et al. |
| 2006/0210326 | A1 | 9/2006 | Takehara et al. |
| 2006/0257176 | A1 | 11/2006 | Kawasaki et al. |
| 2007/0134014 | A1 | 6/2007 | Kato et al. |
| 2008/0075480 | A1 | 3/2008 | Konishi et al. |
| 2008/0131174 | A1 | 6/2008 | Inoue et al. |
| 2008/0199792 | A1 | 8/2008 | Kawasaki et al. |
| 2008/0267641 | A1 | 10/2008 | Konishi et al. |
| 2008/0280225 | A1 | 11/2008 | Konishi et al. |
| 2009/0129830 | A1 | 5/2009 | Adachi et al. |

FOREIGN PATENT DOCUMENTS

| | | | |
|---|---|---|---|
| JP | 11153889 | A * | 6/1999 |
| JP | 2002182532 | A * | 6/2002 |
| JP | 2005-128484 | | 5/2005 |
| JP | 2005-352371 | | 12/2005 |
| JP | 4016949 | | 9/2007 |
| JP | 2008-26844 | | 2/2008 |

OTHER PUBLICATIONS

Kumon (JP 11-53889 A) JPO Machine Translation.*

* cited by examiner

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming apparatus includes an image carrier, a toner-image forming unit, a photosensor, an information obtaining unit, and a toner-amount calculating unit. The toner-image forming unit forms a toner image on the image carrier with toner. The photosensor detects a toner area where the toner is sticking to the image carrier. The information obtaining unit obtains particle-size-change information about how particle size distribution of the toner changes over time. The toner-amount calculating unit calculates a toner amount of the toner image based on the toner area and the particle-size-change information.

5 Claims, 6 Drawing Sheets

| | | | |
|---|---|---|---|
| TONER PARTICLE SIZE (MEAN VOLUME) | $r$ | $<$ | $R$ |
| NUMBER OF TONER PARTICLES PER UNIT AREA | $n$ | $>$ | $N$ |
| TONER AREA | $n\pi r^2$ | $=$ | $N\pi R^2$ |
| TONER AMOUNT (VOLUME) | $4/3n\pi r^3$ | $<$ | $(4/3n\pi r^3) \times \sqrt{(n/N)}$ |

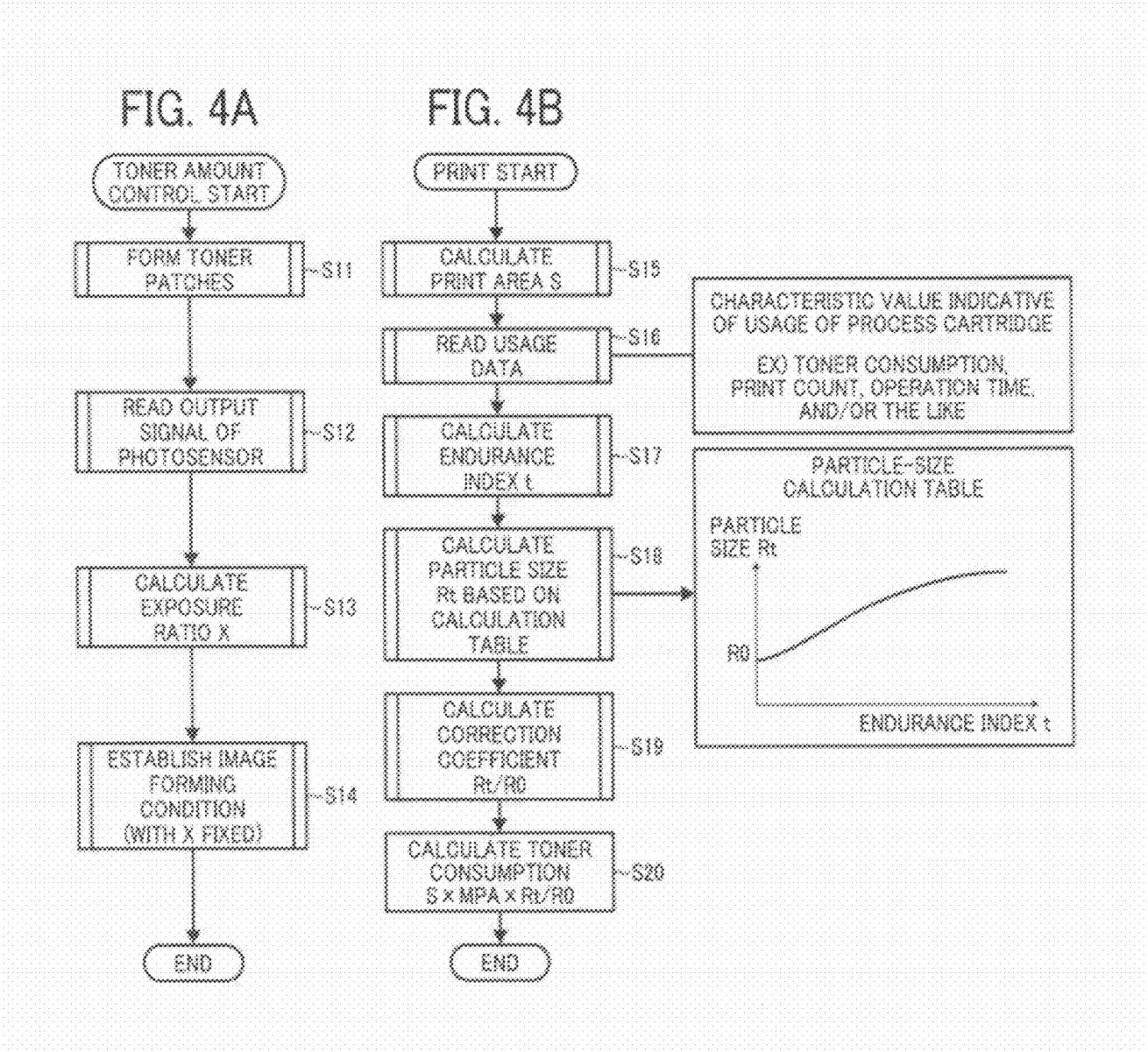
FIG. 4A
TONER AMOUNT CONTROL START
S11
FORM TONER PATCHES
S12
READ OUTPUT SIGNAL OF PHOTOSENSOR
S13
CALCULATE EXPOSURE RATIO X
S14
ESTABLISH IMAGE FORMING CONDITION (WITH X FIXED)
END
FIG. 4B
PRINT START
S15
CALCULATE PRINT AREA S
S16
READ USAGE DATA
CHARACTERISTIC VALUE INDICATIVE OF USAGE OF PROCESS CARTRIDGE
EX) TONER CONSUMPTION, PRINT COUNT, OPERATION TIME, AND/OR THE LIKE
S17
CALCULATE ENDURANCE INDEX t
S18
CALCULATE PARTICLE SIZE Rt BASED ON CALCULATION TABLE
PARTICLE-SIZE CALCULATION TABLE
PARTICLE SIZE Rt
R0
ENDURANCE INDEX t
S19
CALCULATE CORRECTION COEFFICIENT Rt/R0
S20
CALCULATE TONER CONSUMPTION S x MPA x Rt/R0
END

IMAGE FORMING APPARATUS

CROSS-REFERENCE TO RELATED APPLICATIONS

The present application claims priority to and incorporates by reference the entire contents of Japanese Patent Application No. 2008-270760 filed in Japan on Oct. 21, 2008.

BACKGROUND OF THE INVENTION

1. Field of the Invention

The present invention relates generally to an image forming apparatus.

2. Description of the Related Art

Conventionally, various techniques have been devised to maintain image density and tone reproduction in image forming apparatuses. For example, Japanese Patent No. 4016949 and Japanese Patent Application Laid-open No. 2005-128484 disclose techniques of controlling toner-image forming conditions. In this technique, information about the amount of toner that has stuck to a toner patch formed on an image carrier is obtained and toner-image forming conditions are changed based on the obtained toner amount.

A typical example of means for obtaining a toner amount is a photosensor. More specifically, an amount of toner per unit area of a toner patch, or a toner image, is calculated based on a result of detection of the toner patch by the photosensor. More particularly, the mass of toner per unit area of the toner image (hereinafter, "M/A") is calculated from the detected amount of toner per unit area of the toner image on an assumption that particle sizes of the toner that forms the toner patch have a specific distribution.

However, when actual particle size distribution differs from the specific distribution, an error occurs in the calculation of an M/A, making it difficult to obtain an accurate value of M/A.

Meanwhile, because rupture of toner particles can occur during repeated use of the toner particles in the development process, particle size distribution of toner can change over time. A developing unit generally has a characteristic, what is called a selective development, that toner particles in a specific particle size range are likely to be selectively used in development. Due to this selective development, particle size distribution of toner changes over time because toner particles in the specific particle size range are consumed earlier than other toner particles. Developing units can be broadly classified in process-cartridge type developing units and toner-replenishing type developing unit. In the process-cartridge type developing unit, the developing unit is replaced. On the other hand, in the toner-replenishing type developing unit, only the toner is replenished. The change in particle size distribution of toner over time is greater in the process-cartridge type developing units than in the toner-replenishing type developing units. The reason is that, when toner that has been initially filled in the process cartridge is used up, the developing unit is replaced rather than supplying toner from outside. Accordingly, in an image forming apparatus that includes a process-cartridge type developing unit, the disadvantage that it is difficult to obtain an accurate value of toner amount due to the change in particle size distribution of toner is pronounced.

SUMMARY OF THE INVENTION

It is an object of the present invention to at least partially solve the problems in the conventional technology.

According to an aspect of the present invention, there is provided an image forming apparatus including an image carrier; a toner-image forming unit configured to form a toner image on the image carrier with toner; a photosensor that configured to detect a toner area where the toner is sticking to the image carrier form the toner image; an information obtaining unit that obtains particle-size-change information about how particle size distribution of the toner changes over time; and a toner-amount calculating unit that calculates a toner amount based on the toner area and the particle-size-change information, the toner amount being an amount of the toner sticking to the image carrier to form the toner image.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 4A and 4B are flowcharts of process procedures for toner amount control of Example 2;

DETAILED DESCRIPTION OF THE PREFERRED EMBODIMENTS

Exemplary embodiments of the present invention are described in detail below with reference to the accompanying drawings. Configuration and operation of an image forming apparatus according to an embodiment of the present invention will be described.

Figure 1:
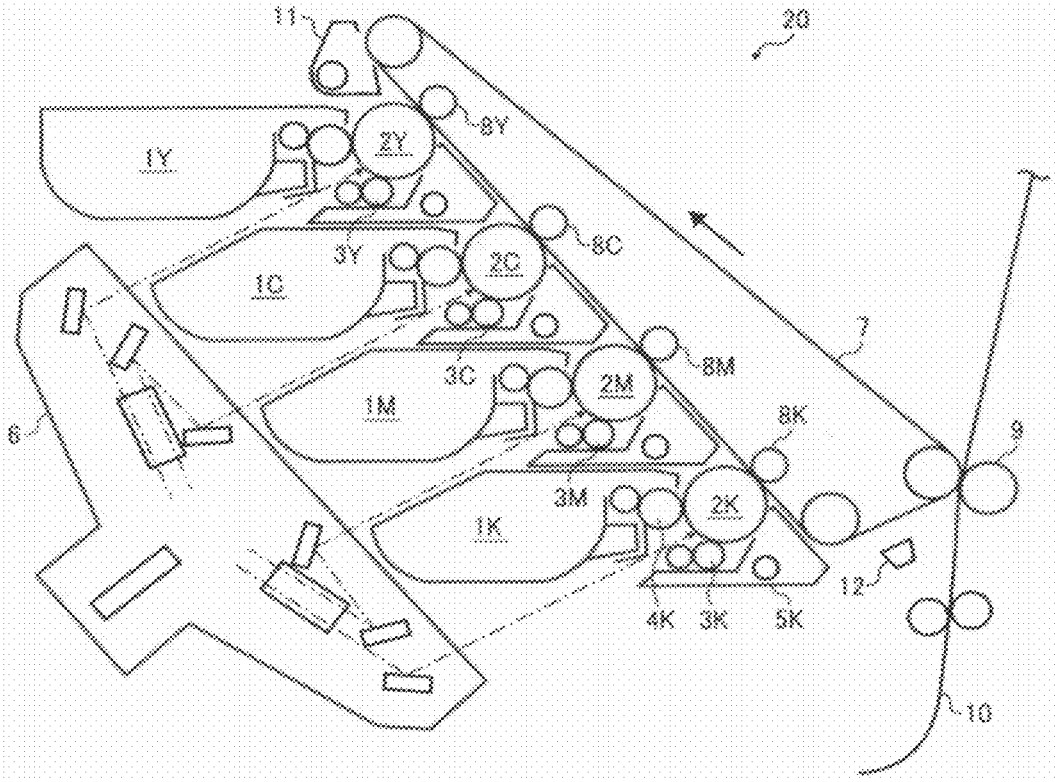
FIG. 1 is a schematic configuration diagram of an image forming apparatus according to an embodiment of the present invention.

FIG. 1 is a schematic configuration diagram of an image forming apparatus 20 according to an embodiment of the present invention. The image forming apparatus 20 is what is called a tandem-type image forming apparatus that includes an intermediate transfer belt 7, which is an intermediate transfer member, that rotates in a direction indicated by an arrow along the surface of the intermediate transfer belt 7 of FIG. 1 and four process cartridges 1Y, 1C, 1M, and 1K that are aligned along the rotating direction of the intermediate transfer belt 7. The process cartridges 1Y, 1C, 1M, and 1K are image forming units for forming a yellow (Y) image, a cyan (C) image, a magenta (M) image, and a black (K) image, respectively. Because the process cartridges 1Y, 1C, 1M, and 1K have the same structure except for the colors of toner contained therein, only the process cartridge 1K will be described hereinbelow and descriptions about the process cartridges 1Y, 1C, and 1M are omitted. There can be more than four or less than four process cartridges.

The process cartridge 1K integrally includes a photosensitive drum 2K, an electrically charging roller 3K, which is an electrically charging unit, a developing unit 4K, and a photosensitive-drum cleaning unit 5K. FIG. 1 also shows photosensitive drums 2M, 2C, and 2Y and electrically charging rollers 3M, 3C, and 3Y corresponding with process cartridges 1M, 1C, and 1Y, respectively. The process cartridge 1K is detachably attached to a main body of the image forming apparatus 20 with a fastener (not shown) that can be unfastened for replacement of the process cartridge 1K.

The electrically charging roller 3K is arranged so as to come into press contact with the surface of the photosensitive drum 2K that rotates in the direction indicated by the arrow in FIG. 1. The electrically charging roller 3K is rotated by rotation of the photosensitive drum 2K. A bias voltage of a predetermined magnitude is applied to the electrically charging roller 3K from a high-voltage power supply (not shown) to electrically charge the surface of the photosensitive drum 2K. The developing unit 4K performs one-component, contact development to develop an electrostatic latent image on the photosensitive drum 2K into a visible image with toner. A developing bias of a predetermined magnitude is applied to the developing unit 4K from a high-voltage power supply (not shown). The photosensitive-drum cleaning unit 5K removes residual toner from the surface of the photosensitive drum 2K.

An exposure unit 6 is arranged in the image forming apparatus 20 on a side opposite from the intermediate transfer belt 7 with the process cartridges 1Y, 1C, 1M, and 1K therebetween. The exposure unit 6 exposes the surface of each of the photosensitive drum 2K to light beams based on image data of a corresponding color, thereby forming an electrostatic latent image. The exposure unit 6 can be a laser beam scanner that uses a laser diode. Alternatively, the exposure unit 6 can be a light emitting diode (LED). The exposure unit 6 also exposes the surface of each of photosensitive drums 2Y, 2C, and 2M for yellow image, cyan image, and magenta image.

The intermediate transfer belt 7 is driven to rotate in the direction indicated by the arrow along the surface of the intermediate transfer belt 7 in FIG. 1 by a drive motor (not shown). Primary transfer rollers 8Y, 8C, 8M, and 8K that transfer toner images from the surfaces of the photosensitive drums 2Y, 2C, 2M, and 2K onto the intermediate transfer belt 7 are arranged on an inside surface of the intermediate transfer belt 7 such that each of the primary transfer rollers 8Y, 8C, 8M, and 8K opposes a corresponding one of the photosensitive drums 2Y, 2C, 2M, and 2K. A secondary transfer roller 9 that transfers the toner images from the intermediate transfer belt 7 onto a recording medium is arranged to oppose an outside surface of the intermediate transfer belt 7 such that the secondary transfer roller 9 comes into contact with the outside surface. A transfer-belt cleaning unit 11 that removes residual toner from the intermediate transfer belt 7 after toner images have been transferred onto a recording medium is arranged downstream, in the rotating direction of the intermediate transfer belt 7, of the secondary transfer roller 9. The recording medium is, for example, a sheet of recording paper 10 depicted in FIG. 1. A fixing device (not shown) is arranged downstream, in a conveyance path of a recording medium, of the secondary transfer roller 9.

Figure 5:
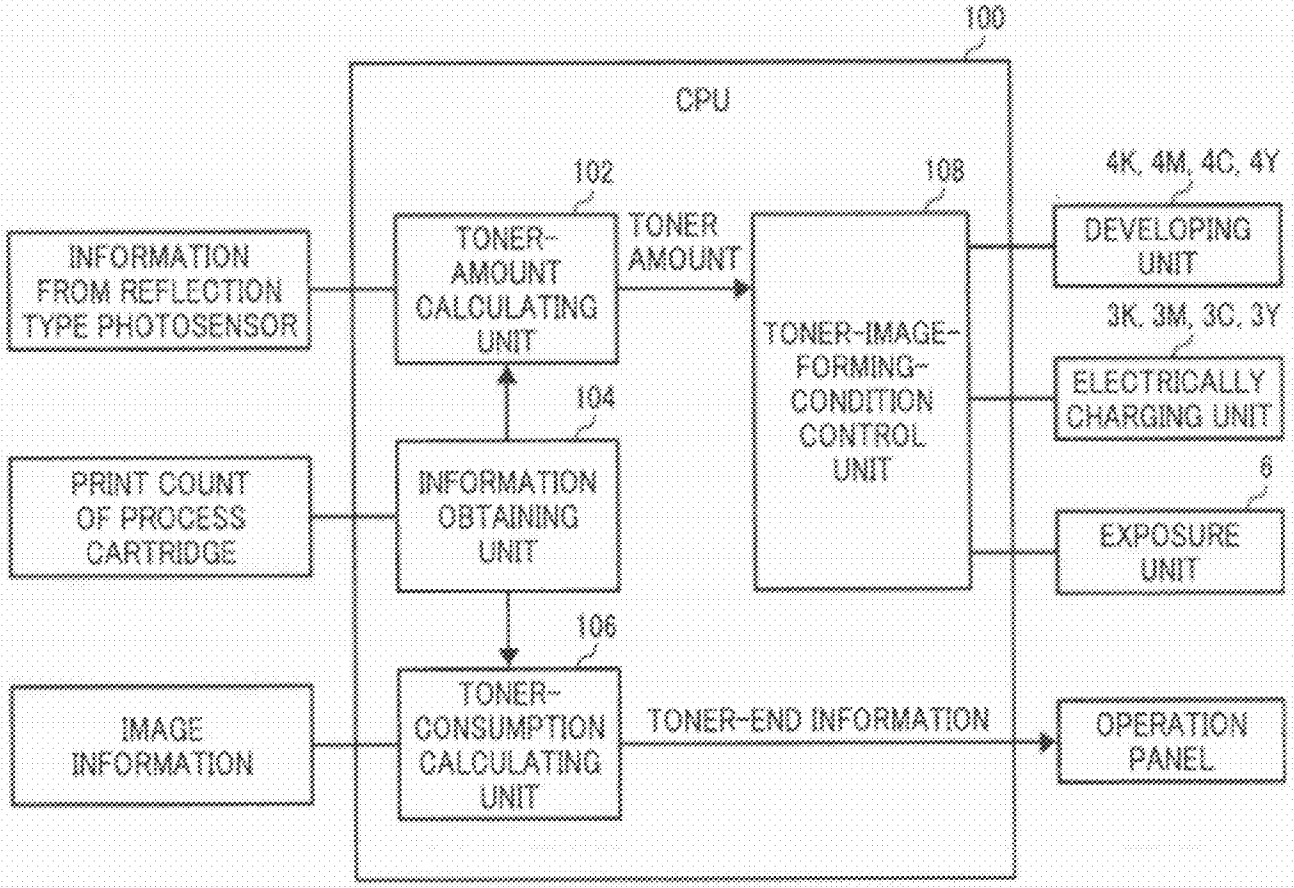
FIG. 5 is a block diagram of an image forming apparatus according to an embodiment of the invention.

When the image forming apparatus 20 receives a signal for starting image forming from operation panel 13, shown in FIG. 5, the intermediate transfer belt 7 starts rotating. Simultaneously, in the process cartridge 1K, the surface of the photosensitive drum 2K is uniformly electrically charged by the electrically charging roller 3K and exposed to laser beams emitted from the exposure unit 6 for formation of an electrostatic latent image. The developing unit 4K develops the electrostatic latent image with black toner. Hence, a black toner image is formed on the surface of the photosensitive drum 2K. Similarly, in the process cartridges 1Y, 1C, and 1M, a yellow toner image, a cyan toner image, and a magenta toner image are formed on the surfaces of the photosensitive drums 2Y, 2C, and 2M, respectively. As the intermediate transfer belt 7 rotates, these color toner images are sequentially transferred from the surfaces of the photosensitive drums 2Y, 2C, 2M, and 2K onto the intermediate transfer belt 7 by the primary transfer rollers 8Y, 8C, 8M, and 8K such that the toner images are superimposed on one another. Hence, a multiple-color toner image is formed on the intermediate transfer belt 7.

Simultaneously, a recording medium is fed from a paper feed cassette (not shown) to a nip between the intermediate transfer belt 7 and the secondary transfer roller 9. The multiple color toner image, which is present on the intermediate transfer belt 7, is transferred from the intermediate transfer belt 7 onto the recording medium at the nip between the intermediate transfer belt 7 and the secondary transfer roller 9. In this manner, a multiple-color image is formed on the recording medium. The recording medium onto which the image has been transferred is conveyed to the fixing device where the transferred image is fixed onto the recording medium. Residual toner on the surface of each of the photosensitive drums 2Y, 2C, 2M, and 2K is removed by a corresponding one of the photosensitive-drum cleaning units 5Y, 5C, 5M, and 5K after the toner image has been transferred onto the recording medium. Residual toner on the intermediate transfer belt 7 is removed by the transfer-belt cleaning unit 11 after the multiple-color toner image has been transferred onto the recording medium.

Configuration that features the image forming apparatus 20 will be described below. Note that a reference symbol that represents a color of toner is omitted in some cases for brevity; for example, a developing unit 4 will be used to denote an arbitrary one of the developing units 4Y, 4C, 4M, and 4K. The image forming apparatus 20 performs toner amount control by forming a toner image at predetermined timing, transferring the toner image onto the intermediate transfer belt 7, and calculating an amount of toner remaining onto the intermediate transfer belt 7 (hereinafter, "toner amount") to form the toner image. Examples of the image forming apparatus 20 will be described in detail below.

Example 1 will be described below. In Example 1, the image forming apparatus 20 depicted in FIG. 1 forms one or more toner patches on a photosensitive drum 2 under a certain type of an image forming condition. The toner patches are then transferred onto the intermediate transfer belt 7. A reflection-type photosensor 12 is arranged to oppose the intermediate transfer belt 7. The reflection-type photosensor 12 detects the toner patches on the intermediate transfer belt 7. A toner amount of each of the toner patches on the intermediate transfer belt 7 is then determined based on a signal output from the reflection-type photosensor 12. The image forming condition is then varied and the above process is repeated thereby obtaining a set of toner amounts corresponding to the type of the image forming condition. An approximation equation is then obtained from the thus-obtained toner amounts for the type of the image forming condition. Based on the approximation equation, an image forming condition that enable formation of a toner patch whose toner amount is a target toner amount M is determined. The image forming condition can be a parameter that includes at least any one of the following:

a) a value of the electrically charging bias to be applied to the electrically charging roller 3, b) a value of the developing bias to be applied to a developing roller of the developing unit 4, and c) a quantity of exposure light to be emitted from the exposure unit 6.

By changing the developing bias, the thickness of a toner layer (density of a solid image) can be adjusted. By changing the charging bias and the quantity of exposure light, a dot size (tone reproduction) can be adjusted. The target value M of the toner amount can be appropriately determined depending on a use environment and an endurance condition of the image forming apparatus 20, and a type of a recording medium to be used.

The reflection-type photosensor 12 includes an LED (not shown) and a phototransistor (not shown). The phototransistor that is arranged to be symmetrical with the LED about a vertical plane functions as a specularly reflecting photodetector. An aperture is arranged in front of the specularly reflecting photodetector so as to reduce entry of diffused light to a minimum.

An area (hereinafter, "toner area") where toner is sticking in a toner patch on the intermediate transfer belt 7 is obtained by using the reflection-type photosensor 12 by utilizing a fact that, when the intermediate transfer belt 7 is illuminated with light, intensity and direction of light reflected from the toner area differ from those of light reflected from an area (hereinafter, "exposed area") where toner is not sticking in the toner patch. Incident light on the exposed area is specularly reflected because the smooth surface of the exposed area reflects incident light as does a mirror surface. In contrast, incident light on the toner area is diffusely reflected because the surface of the toner area is rough. Accordingly, a ratio (hereinafter, "exposure ratio") of an exposed area to a toner area of a toner patch formed on the intermediate transfer belt 7 can be obtained from an amount of light that is specularly reflected from the toner patch and detected by the reflection-type photosensor 12.

Figure 2:
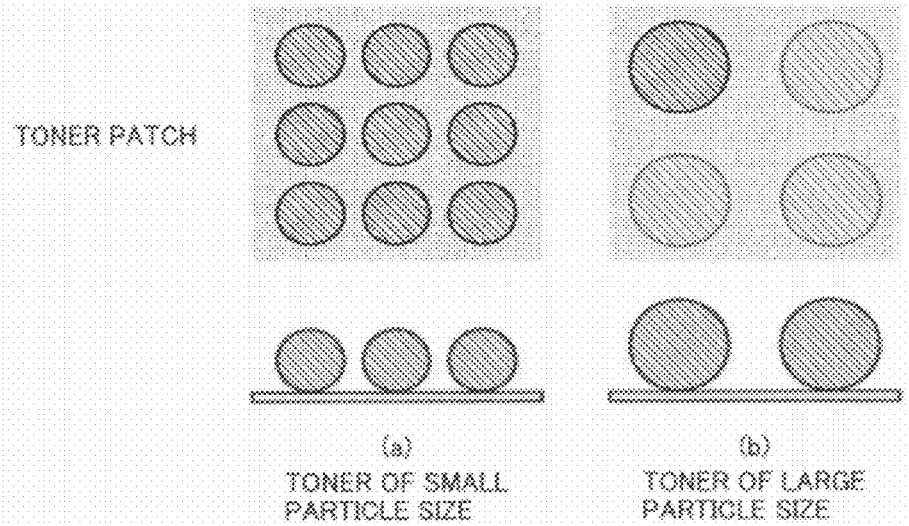
FIG. 2 is a schematic diagram illustrating a relationship between cross-sectional areas of toner particles obtained based on results of detection by a photosensor and toner amounts.

If particle size distribution of toner sticking to the intermediate transfer belt 7 to form a toner patch is known in advance, it is possible to uniquely estimate a toner amount (toner mass) of the toner patch based on the exposure ratio. FIG. 2 is a schematic diagram illustrating a relationship between cross-sectional areas of toner particles as viewed in a direction orthogonal to a toner area and volumes of the toner particles. It is assumed that all the toner particles are spheres of the same diameter and arranged on the toner area in a single layer without being overlaid on one another.

(a) in FIG. 2, in which r is a particle size of toner that forms a first toner patch, illustrates that it is possible to calculate a toner amount (volume) from an exposure ratio, which is a ratio of an exposed area to a toner area. In contrast, (b) in FIG. 2 illustrates that if a particle size R of toner that forms a second toner patch is large, even when the exposure ratio is equal to that of the first toner patch depicted in (a) in FIG. 2, a second toner amount (volume) of the second toner patch differs from a first toner amount of the first toner patch. In such a schematic toner patch as depicted in FIG. 2, even when an exposure ratio is fixed, the larger that particle size of toner that forms a toner patch, the larger the amount of the toner that forms the toner patch. Put another way, if a toner particle size of toner that forms a toner patch is unknown, it is difficult to estimate a toner amount accurately from an exposure ratio while when the toner particle size is known, it is possible to calculate the toner amount accurately.

A toner area obtained based on a result of detection by the reflection-type photosensor 12 can have an error of a certain amount because, in an actually-formed toner patch, toner particles are not of a uniform size and an angle of incidence and reflection of light emitted from an LED is not normal to the surface of the intermediate transfer belt 7. Although such an error can occur, it generally holds true for an actually-formed toner patch that the larger that particle size of toner that forms the toner patch, the larger the amount of the toner that forms the toner patch. Accordingly, when information about particle size distribution of toner that forms a toner patch is available, it is possible to calculate a toner amount accurately from an exposure ratio based on the information.

Hence, the image forming apparatus 20 can obtain an accurate toner amount of toner that forms a toner patch with consideration given to particle size distribution. Each of the process cartridges 1Y, 1C, 1M, and 1K includes a storage unit (not shown) that stores therein data about usage status of a process cartridge 1 (hereinafter, "usage data"), an amount of toner filled in the process cartridge 1 (hereinafter, "filled amount"), a toner color, a serial number, and the like. The usage data stored in the storage unit is updated as occasion arises.

The image forming apparatus 20 also includes a toner-amount calculating unit 102, shown in FIG. 5, that stores therein a cross-reference table (particle-size calculation table) of relationship between the usage data, or endurance index t, and mean toner particle size.

Figure 3:
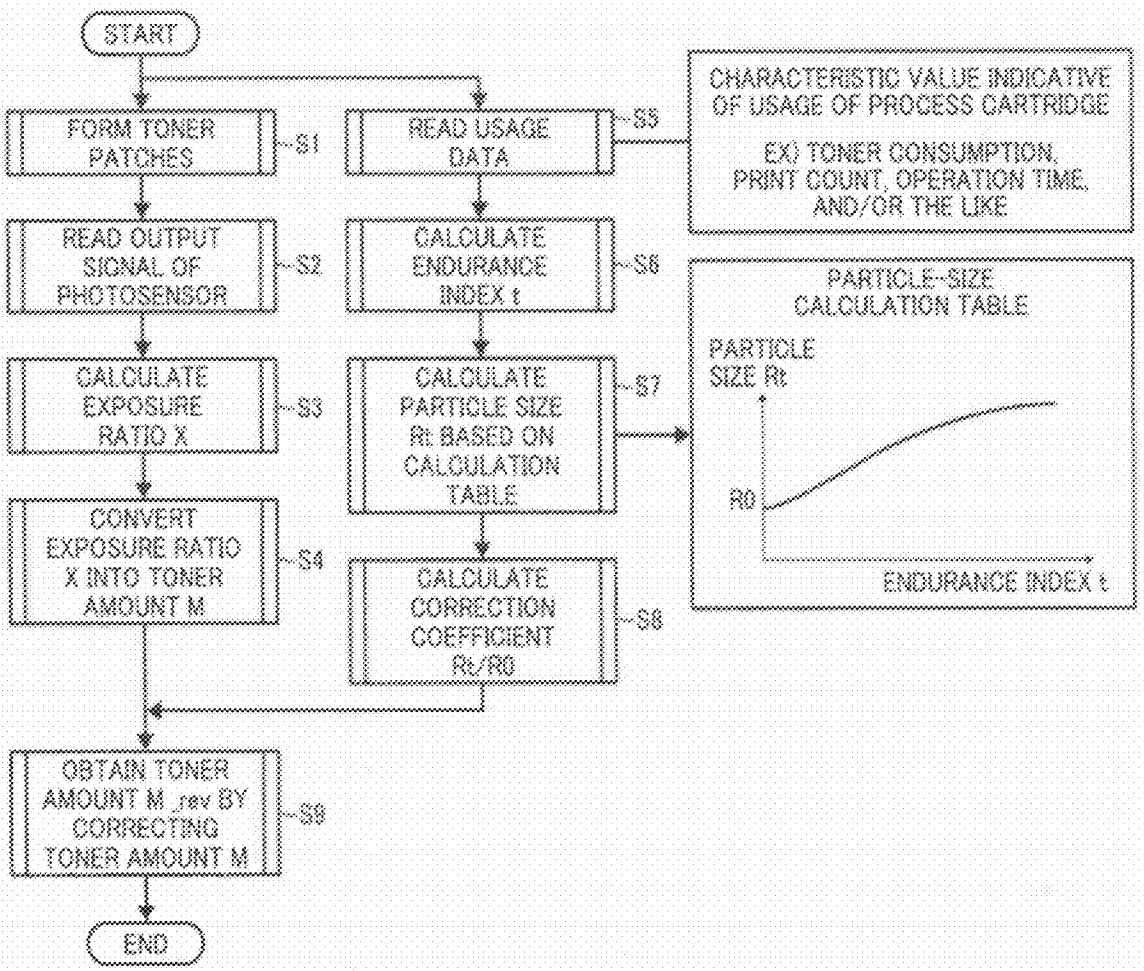
FIG. 3 is a flowchart of a process procedure for toner amount control of Example 1.

FIG. 3 is a flowchart of a process procedure for toner amount control of Example 1. When the toner amount control is started, a plurality of toner patches P(i) are formed and transferred onto the intermediate transfer belt 7 (Step S1). The reflection-type photosensor 12 detects each the toner patches P(i) and outputs a signal (Step S2). The toner-amount calculating unit 102 calculates exposure ratios X(i) based on the signals output from the reflection-type photosensor 12 (Step S3). The storage unit 400, shown in FIG. 6, of the main body of the image forming apparatus 20 stores therein a cross-reference table (toner-amount translation table) of toner amounts and exposure ratios for a reference particle size R0 in advance. The exposure ratios X(i) are converted into toner amounts M(i) by using the toner-amount translation table (Step S4). The usage data about usage status of the process cartridge 1 that is stored in the storage unit of the process cartridge 1 is read from the storage unit (Step S5). The endurance index t is calculated from at least any one of a toner consumption, a toner consumption ratio, a print count, a distance traveled by the photosensitive drum 2, and an accumulative operation time (Step S6). The toner consumption ratio is a ratio of a toner consumption to a filled amount of the process cartridge 1. A mean toner particle size Rt of toner sticking to the intermediate transfer belt 7 at the present time is calculated by using the cross-reference table (particle-size calculation table) of relationship between the endurance index t and the mean toner particle size that is stored in advance (Step S7). After calculation of a correction coefficient Rt/R0 (Step S8), a corrected toner amount M_rev(i) is obtained from M_rev(i)=M(i)×Rt/R0, where Rt is the mean toner particle size, R0 is the reference particle size, and M(i) is the toner amount (Step S9). The corrected toner amount M_rev(i) obtained by correcting the toner amount M(i) based on the mean particle size Rt can be assumed as an accurate value of toner amount with toner particle size of toner that forms a toner patch taken into consideration.

In the present embodiment, the toner-amount calculating unit 102 obtains the toner amount in two steps. That is, first the toner-amount calculating unit 102 converts the exposure ratios X(i) into the toner amounts M(i) by using the toner-amount translation table. Then, the toner-amount calculating unit 102 corrects the toner amounts M(i) into corrected toner amounts M_rev(i) based on the mean toner particle size Rt. The method for calculating the toner amount is not limited thereto. For example, the toner-amount calculating unit 102 can obtain the toner amounts M(i) from M(i)=f(X(i), Rt). More specifically, the toner amounts M(i) can be obtained by storing the function M=f(X, R) that expresses a relationship among the exposure ratio X, the mean toner particle size R, and the toner amount M in advance and substituting X(i) and Rt into the function.

By obtaining information about particle size distribution of toner and calculating a toner amount from a toner area obtained based on a result of detection by the reflection-type photosensor 12 and the information about particle size distribution in this manner, an accurate value of toner amount can be obtained. Hence, even in a system where particle size distribution of toner changes over time, it is possible to obtain an accurate value of toner amount and to maintain image density and tone reproduction appropriately.

FIG. 4A is a flowchart of a process procedure for toner amount control of Example 2. As in Example 1, in Example 2, one or more toner patches are formed on the intermediate transfer belt 7 at predetermined timing (Step S11). The reflection-type photosensor 12 detects each the toner patches and outputs a signal (Step S12). Exposure ratios X are calculated based on the signal (Step S13) and an image forming condition is determined so that a toner amount is maintained appropriately. The mean toner particle size Rt of toner sticking to the intermediate transfer belt 7 to form the toner patch is calculated depending on usage data about usage status of the process cartridge 1. By correcting the toner amount by using the mean toner particle size Rt, an accurate value of toner amount is obtained in Example 2. The process procedure of Example 2 differs from that of Example 1 in obtaining an approximate expression for an image forming condition and the exposure ratio X and setting an image forming condition such that an exposure ratio under the image forming condition achieves a target exposure ratio X0 (Step S14). So long as transfer efficiency does not fluctuate greatly, the exposure ratio X of the intermediate transfer belt 7 is in good relation with a reflection density of an image that is formed on a recording medium, and relationship between the exposure ratio X and the reflection density is substantially constant independent of toner particle size. Accordingly, it is possible to maintain an image density on a recording medium constant by adjusting the image forming condition to maintain the exposure ratio X0 constant.

Even when toner amount is controlled in this manner, if the particle size distribution of toner for use in development is greatly changed, it is difficult to obtain an accurate value of toner amount by using a conventional method of obtaining a toner amount. However, an accurate value of toner amount can be obtained by obtaining information about particle size distribution of toner using an information obtaining unit 104, shown in FIG. 5, and calculating a toner amount based on the information as in Example 1.

The image forming apparatus 20 of Example 2 further includes a toner-consumption calculating unit 106, shown in FIG. 5, that calculates a toner consumption based on image data.

Meanwhile, the disadvantage of a conventional toner-consumption calculating unit, such as that disclosed in Japanese Patent Application Laid-open No. 2008-026844, can be overcome by obtaining information about particle size distribution of toner and correcting a toner amount based on the information about particle size distribution of toner.

Techniques for estimating a toner consumption based on image data have been disclosed. For example, a technique of estimating a toner consumption by using a toner-consumption calculating unit is disclosed in Japanese Patent Application Laid-open No. 2008-026844. This technique enables detection of empty toner-bin without the use of a dedicated sensor. In this technique, whether the toner bin is empty is determined by estimating a toner consumption from the image data. However, this estimation of a toner consumption is performed on an assumption that a toner amount of a toner image and tone reproduction are appropriate. Accordingly, when an obtained value of toner amount has an error due to a change in toner particle size distribution, the estimated value of toner consumption also has an error.

FIG. 4B is a flowchart of a process procedure for calculation of a toner consumption of Example 2. The toner-consumption calculating unit 106 calculates a print area S, which is an area of an image to be formed converted into an area of a solid image, based on the number of dots and density of the image to be formed on a page-by-page basis (Step S15). Usage data about usage status of the process cartridge 1 is stored in the storage unit of the process cartridge 1. The usage data is read from the storage unit (Step S16), and the endurance index t is calculated (Step S17). A cross-reference table (particle-size calculation table) that provides relationship between the endurance index t and mean toner particle size is stored in advance. The mean toner particle size Rt of toner sticking to the intermediate transfer belt 7 at the present time is obtained by using the cross-reference table (Step S18). The correction coefficient Rt/R0 is calculated (Step S19). The toner-consumption calculating unit 106 stores therein in advance a toner amount MPA, which is a toner amount per unit area of a solid image that is developed on the intermediate transfer belt 7 with toner of which mean particle size is the reference particle size R0. A toner amount M_solid, which is a toner amount per unit area of a solid image that is formed with toner of which mean particle size is Rt, is calculated as M_solid=MPA×Rt/R0. Hence, a toner consumption is calculated by multiplying the toner amount M_solid by the print area S (i.e., the toner consumption is calculated as S×MPA×Rt/R0) (Step S20). By calculating the toner consumption in this manner, it is possible to estimate an accurate value of toner consumption, thereby detecting toner-bin empty accurately without arranging an additional sensor for detecting toner-bin empty.

By obtaining the information about particle size distribution of toner and calculating a toner amount from a toner area that is obtained from a result of detection by the reflection-type photosensor 12 and the information about particle size distribution in this manner, an accurate value of toner amount can be obtained. Hence, even in a system where particle size distribution of toner changes over time, it is possible to obtain an accurate value of toner amount and to maintain image density and tone reproduction appropriately. Furthermore, a toner consumption can be estimated accurately based on image data.

Embodiments and Examples of the present invention have been described; however, the invention is not limited thereto, and can be modified in various manners within the scope of the invention. For example, in the embodiment, a tandem-type image forming apparatus that employs an intermediate transfer method has been described; however, the image forming apparatus 20 can be of a single-drum type and/or employ a direct transfer method. A position where a toner patch is formed and detected is not limited to the surface of the intermediate transfer belt 7 and can be the surface of the photosensitive drum 2.

According to an aspect of the present invention, an image forming apparatus includes an information obtaining unit 104 and a toner-amount calculating unit 102. The information obtaining unit 104 obtains particle-size-change information about how particle size distribution of toner, with which a toner patch is formed on an intermediate transfer belt, changes over time. The toner-amount calculating unit 102 calculates an amount of toner sticking to the intermediate transfer belt to form the toner patch based on a toner area that is obtained based on a result of detection by a reflection-type photosensor and the particle-size-change information. By calculating a toner amount in this manner, an accurate value of toner amount can be obtained even when the particle size distribution of the toner changes over time.

The image forming apparatus can include a process cartridge that is detachably attached to a main body of the image forming apparatus. The process cartridge includes a developing unit and preferably stores therein in advance particle-size-change information in which usage data about usage status of the process cartridge is associated with change in particle size distribution. Because the particle-size-change information is stored in the process cartridge in advance, it is easy to obtain the particle-size-change information.

The information obtaining unit 104 can obtain the particle-size-change information based on an accumulative toner consumption over periods of time in which the process cartridge has been used. In the process cartridge, because toner particles of a specific particle size range are selectively used in development and reduced in number gradually, particle size distribution of toner is likely to change over time. However, with the understanding of this selective development, it is possible to estimate particle size distribution of toner at the present time based on a toner consumption relatively less expensively without arranging a dedicated sensor or the like.

The information obtaining unit 104 can obtain the particle-size-change information based on a toner consumption ratio that is a ratio of the accumulative toner consumption to an amount of toner initially filled in the process cartridge. In the process cartridge, because toner particles of a specific particle size range are selectively used in development and reduced in number gradually, particle size distribution of toner is likely to change over time. However, with the understanding of this selective development, it is possible to estimate particle size distribution of toner at the present time based on the amount of toner initially filled in the process cartridge, particle size distribution of toner, and the toner consumption ratio even when the amount of toner filled in the process cartridge varies from one process cartridge to another relatively less expensively without arranging a dedicated sensor or the like.

The information obtaining unit 104 can obtain the particle-size-change information based on an operation time of the process cartridge. In the process cartridge, because toner particles of a specific particle size range are selectively used in development and reduced in number gradually, particle size distribution of toner is likely to change over time. However, with the understanding of this selective development, it is possible to estimate particle size distribution of toner at the present time based on the operation time of the process cartridge relatively less expensively without arranging a dedicated sensor or the like.

The information obtaining unit 104 can obtain the particle-size-change information based on an accumulative print count of the process cartridge. The print count is the number of sheets of recording medium on each of which an image is formed by using the process cartridge. In the process cartridge, because toner particles of a specific particle size range are selectively used in development and reduced in number gradually, particle size distribution of toner is likely to change over time. However, with the understanding of this selective development, it is possible to estimate particle size distribution of toner at the present time based on the accumulative print count of the process cartridge relatively less expensively without arranging a dedicated sensor or the like.

A toner-image-forming-condition control unit 108, shown in FIG. 5, can control a toner-image forming condition, under which the toner-image forming unit forms the toner image, based on the toner amount calculated by the toner-amount calculating unit 102, thereby maintaining image density and tone reproduction appropriately.

The toner-image forming condition to be controlled by the toner-image-forming-condition control unit 108 can be determined by a parameter that includes at least any one of a value of developing bias, a value of electrically charging bias, and a quantity of light emitted for exposure. By changing the developing bias, the thickness of a toner layer (density of a solid image) can be adjusted. By changing the charging bias and the value of quantity of light, a dot size (tone reproductively) can be adjusted.

The image forming apparatus can include a toner-consumption calculating unit 106 that calculates a toner consumption based on image data based on which an image is to be formed. The toner-consumption calculating unit 106 corrects the toner consumption based on the particle-size-change information obtained by the information obtaining unit 104. The toner-consumption calculation described above permits accurate estimation of a toner consumption without arranging a sensor that detects toner-bin empty, which leads to accurate detection of toner-bin empty. This can permit to manufacture the image forming apparatus less expensively.

According to an aspect of the invention, there is obtained an advantage that an amount of toner sticking to an image carrier to form a toner image can be determined accurately even when particle size distribution of the toner changes over time.

Figure 6:
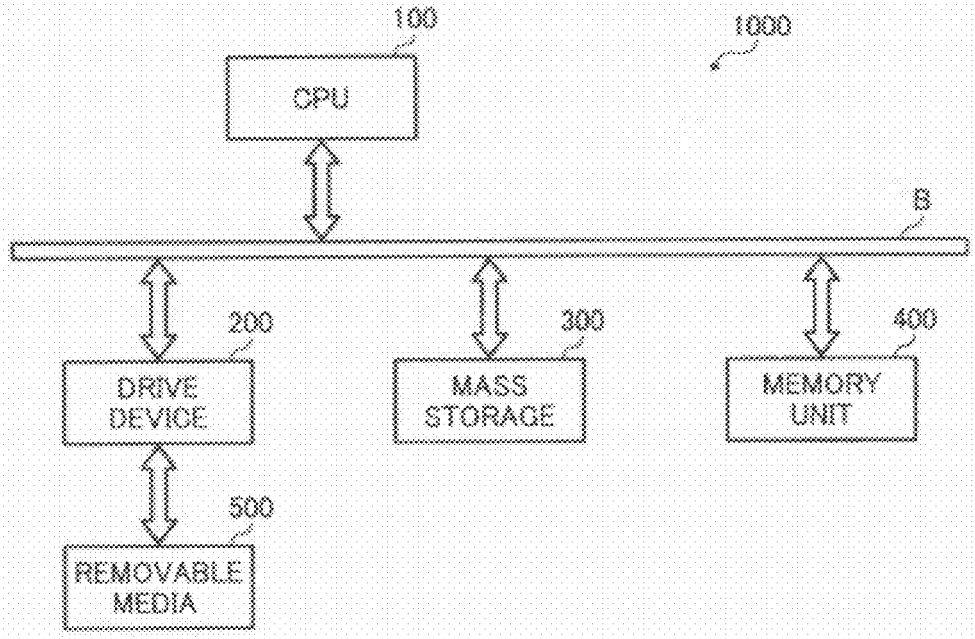
FIG. 6 is a high level block diagram of a computer system included in the image forming apparatus according to an embodiment of the invention.

FIG. 6 is a high level block diagram of a computer system 1000 included in the image forming apparatus according to an embodiment of the invention. The computer system 1000 includes a bus B or other communication mechanism for communicating information and a processor/CPU 100, shown in FIG. 5, coupled with the bus B for processing the information. The computer system 1000 includes a main memory/memory unit 400, such as random access memory (RAM) or other dynamic storage device (e.g., dynamic RAM (DRAM), static RAM (SRAM), and synchronous DRAM (SDRAM)), coupled to the bus B for storing information and instructions to be executed by the CPU 100. In addition, the memory unit 400 may be used for storing temporary variables or other intermediate information during the execution of instructions by the CPU 100. The computer system 1000 may also further include a read only memory (ROM) or other static storage device (e.g., programmable ROM (PROM), erasable PROM (EPROM), and electrically erasable PROM (EEPROM)) coupled to the bus B for storing static information and instructions for the CPU 100.

The computer system 1000 may also include a disk controller coupled to the bus B to control one or more storage devices for storing information and instructions, such as mass storage 300 which may be a hard disk drive, for example, and drive device 200 (e.g., floppy disk drive, read-only compact disc drive, read/write compact disc drive, compact disc jukebox, tape drive, flash memory or a flash memory based drive, and removable magneto-optical drive). The storage devices may be added to the computer system 1000 using an appropriate device interface (e.g., small computer system interface (SCSI), integrated device electronics (IDE), enhanced-IDE (E-IDE), direct memory access (DMA), or ultra-DMA). The storage unit of each process cartridge may comprise one or more mass storage units.

The computer system 1000 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)) in order to carry out the desired functionality.

One or more processors in a multi-processing arrangement may also be employed to execute the sequences of instructions contained in the memory unit 400 or a removable media 500. In alternative embodiments, hard-wired circuitry may be used in place of or in combination with software instructions. Thus, embodiments are not limited to any specific combination of hardware circuitry and software.

As stated above, the computer system 1000 may include at least one removable media 500, which is a computer-readable medium, or memory for holding instructions programmed according to the teachings described herein and for containing data structures, tables, records, or other data described herein. Examples of computer-readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other storage medium from which a computer can read.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier;

a toner-image forming unit configured to form a toner image on the image carrier with toner;

a photosensor that is configured to detect a toner area where the toner is sticking to the image carrier form the toner image;

an information obtaining unit that obtains particle-size-change information about how particle size distribution of the toner changes over time;

a toner-amount calculating unit that calculates a toner amount based on the toner area and the particle-size-change information, the toner amount being an amount of the toner sticking to the image carrier to form the toner image, and a process cartridge detachably attached to a main body of the image forming apparatus, the process cartridge including at least a developing unit of the toner-image forming unit, wherein the information obtaining unit obtains the particle-size-change information based on a toner consumption ratio that is a ratio of an accumulative toner consumption over periods of time in which the process cartridge has been used to an amount of toner initially filled in the process cartridge.

2. The image forming apparatus according to claim 1, wherein the photosensor is a reflection-type photosensor.

3. The image forming apparatus according to claim 1, further comprising a toner-image-forming-condition control unit that controls a toner-image forming condition, under which the toner-image forming unit forms the toner image, based on the toner amount calculated by the toner-amount calculating unit.

4. The image forming apparatus according to claim 3, wherein the toner-image forming condition to be controlled by the toner-image-forming-condition control unit is determined by a parameter that includes at least any one a value of developing bias, a value of electrically charging bias, and a quantity of light emitted for exposure.

5. The image forming apparatus according to claim 1, further comprising a toner-consumption calculating unit that calculates a toner consumption based on image data, based on which the image forming apparatus forms an image, wherein the toner-consumption calculating unit corrects the toner consumption based on the particle-size-change information.

* * * * *